US005316282A

United States Patent [19]

Fukube et al.

[11] Patent Number: 5,316,282

[45] Date of Patent: May 31, 1994

[54] SHEET FEEDING AND SEPARATING DEVICE FOR IMAGE FORMING EQUIPMENT

[75] Inventors: Noriaki Fukube, Soka; Katsumi Kurihara; Satoshi Takano, both of Tokyo; Hiroshi Tanabe, Yokohama; Hiroshi Fujiwara, Tokyo; Kazunori Bannai, Tokyo; Hiroyuki Inobe, Tokyo, all of Japan

[73] Assignee: Ricoh Company, Ltd., Tokyo, Japan

[21] Appl. No.: 67,006

[22] Filed: May 26, 1993

Related U.S. Application Data

[62] Division of Ser. No. 774,349, Oct. 10, 1991, Pat. No. 5,219,154.

[30] Foreign Application Priority Data

| | | | |
|---|---|---|---|
| Oct. 11, 1990 | [JP] | Japan | 2-270507 |
| Oct. 22, 1990 | [JP] | Japan | 2-283707 |
| May 16, 1991 | [JP] | Japan | 3-111922 |

[51] Int. Cl.[5] ..... B65H 5/00

[52] U.S. Cl. ..... 271/10; 271/18.1

[58] Field of Search ..... 271/18.1, 18.2, 34, 271/193, 10

[56] References Cited

U.S. PATENT DOCUMENTS

| | | | |
|---|---|---|---|
| 4,244,465 | 1/1981 | Hishikawa et al. | 271/193 |
| 4,526,357 | 7/1985 | Kuehnle et al. | 271/18.2 |
| 4,864,461 | 9/1989 | Kasahara | 271/193 |
| 5,121,170 | 6/1992 | Bannai et al. | 271/275 |
| 5,219,154 | 6/1993 | Fukube et al. | 271/18.2 |

FOREIGN PATENT DOCUMENTS

| | | | |
|---|---|---|---|
| 627040 | 10/1978 | U.S.S.R. | 271/18.1 |
| 640942 | 1/1979 | U.S.S.R. | 271/18.1 |

*Primary Examiner*—H. Grant Skaggs

*Attorney, Agent, or Firm*—Oblon, Spivak, McClelland, Maier & Neustadt

[57] ABSTRACT

A sheet feeding and separting device incorporated in image forming equipment for feeding sheets one by one from a sheet stack while preventing two or more sheets from being fed together as far as possible and, when a plurality of sheets are accidentally fed together, surely separating one of them from the others. A pick-up member is implemented as an endless dielectric belt. An AC power source forms a charge pattern on the belt via an electrode. As a result, the belt retains a sheet by attraction and transports it due to the Maxwell stress generated in the sheet. When a plurality of sheets are fed together, an arresting member which faces the belt separates one of them from the others. Alternatively, a charge pattern may be formed on the surface of the arresting member.

2 Claims, 8 Drawing Sheets

SHEET FEEDING AND SEPARATING DEVICE FOR IMAGE FORMING EQUIPMENT

This is a division, of application Ser. No. 07/774,349, filed on Oct. 10, 1991 and now U.S. Pat. No. 5,219,154.

BACKGROUND OF THE INVENTION

The present invention relates to a sheet feeding and separating device for image forming equipment.

An electrophotographic copier, facsimile apparatus, printer or similar image forming equipment includes a device for feeding recording sheets one by one to an image forming station. It is a common practice to implement such a sheet feeding device with a friction type system using a pick-up member in the form of a roller or a belt. The roller or belt is made of rubber or similar material having a great coefficient of friction. Although friction type sheet feed system is simple in construction, it cannot feed sheets stably over a long period of time. This stems from the fact that the pick-up member has to be pressed against the sheet surface by biasing means such as a spring to achieve a great frictional force, and the pick-up member made of rubber or similar material has the coefficient of friction of the surface thereof changed by aging and by environmental conditions.

A suction type sheet feed system is also available which generates vacuum by the suction of air to thereby transport a sheet. While this type of system is more stable than the friction type system, it is not feasible for office and home use since it produces great noise due to the suction of air and increases the overall dimensions of the device.

On the other hand, it is likely that the friction type sheet feed system pays out two or more sheets at the same time. It is, therefore, necessary to use a device for separating one of such sheets from the others. This kind of device is often implemented with a friction pad made of rubber or similar material having a great coefficient of friction or a member rotatable in a direction opposite to the intended direction of sheet feed, i.e., a counter-feed direction. The friction pad or the rotatable member is held in pressing contact with the pick-up member or a transport roller located downstream of the pick-up roller. The coefficient of friction between the pick-up roller or the transport roller and a sheet, the coefficient of friction between the friction pad or the rotatable member and a sheet, and the coefficient of friction between sheets are sequentially reduced in this order. In this configuration, when a plurality of sheets are paid out together, one of them which contacts, for example, the pick-up roller is separated from the others and fed out. When only one sheet is paid out by the pick-up roller, it is fed out against the friction between, for example, the friction pad and the sheet. This type of separating device, however, cannot surely separate sheets when the sheets stacked on a cassette are stuck together due to the absence of air layer therebetween or static electricity or when the sheets are nappy and twine together on the surfaces thereof.

U.S. Pat. No. 2,459,773 (Japanese Patent Laid-Open Publication No. 7847/1981) discloses a sheet separating device using a transport roller and a reversible arresting roller in place of the above-stated friction pad. The transport roller and arresting roller are located downstream of a pick-up roller and on both sides of a sheet transport path. The transport roller is rotatable in the direction of sheet feed while the arresting roller is subjected to a constant torque in the counter-feed direction. When the transport roller and arresting roller are directly pressed against each other or when only a single sheet is paid out by the pick-up roller to between the transport roller and reversible roller, the arresting roller does not slip on the transport roller or the sheet. This is successful in eliminating the wear of the rollers, the decrease in the coefficient of friction, paper dust ascribable to operations, and the decrease in the coefficient of friction due to such paper dust. However, since this type of separating device still relies on the difference between the coefficient of friction between the rollers and the sheet and the coefficient of friction between the sheets, it cannot surely separate one of a plurality of sheets paid out together from the others when sheets stacked in a cassette are stuck together for the previously stated reasons.

SUMMARY OF THE INVENTION

It is, therefore, an object of the present invention to provide a sheet feeding device for image forming equipment capable of feeding sheets one by one stably over a long period of time without resorting to sheet separating means.

It is another object of the present invention to provide a sheet feeding and separating device for image forming equipment capable of separating and feeding sheets stably even when a pick-up member accidentally pays out a plurality of sheets at the same time.

In accordance with the present invention, a sheet feeding device comprises a pick-up member facing the top of a stack of sheets and movable in an intended direction of sheet feed for picking up a sheet from the top of the stack to feed the sheet, the pick-up means comprising an endless dielectric belt, and a charge pattern forming member for applying an alternating voltage to the surface of the dielectric belt to thereby form an alternating charge pattern on the surface of the dielectric belt.

Also, in accordance with the present invention, a sheet feeding and separating device comprises a feeding member in the form of a pick-up member and facing the top of a stack of sheets and movable in an intended direction of sheet feed for feeding a sheet from the top of the stack, a separating member facing the pick-up member with the intermediary of a sheet transport path for separating, when a plurality of sheets are paid out together by the pick-up member, one of the sheets from the others, the separating member comprising an arresting member which is stationary and movable in the intended direction of sheet feed, and a charge pattern forming member for forming an alternating charge pattern on the surface of either one of the pick-up member and the arresting member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
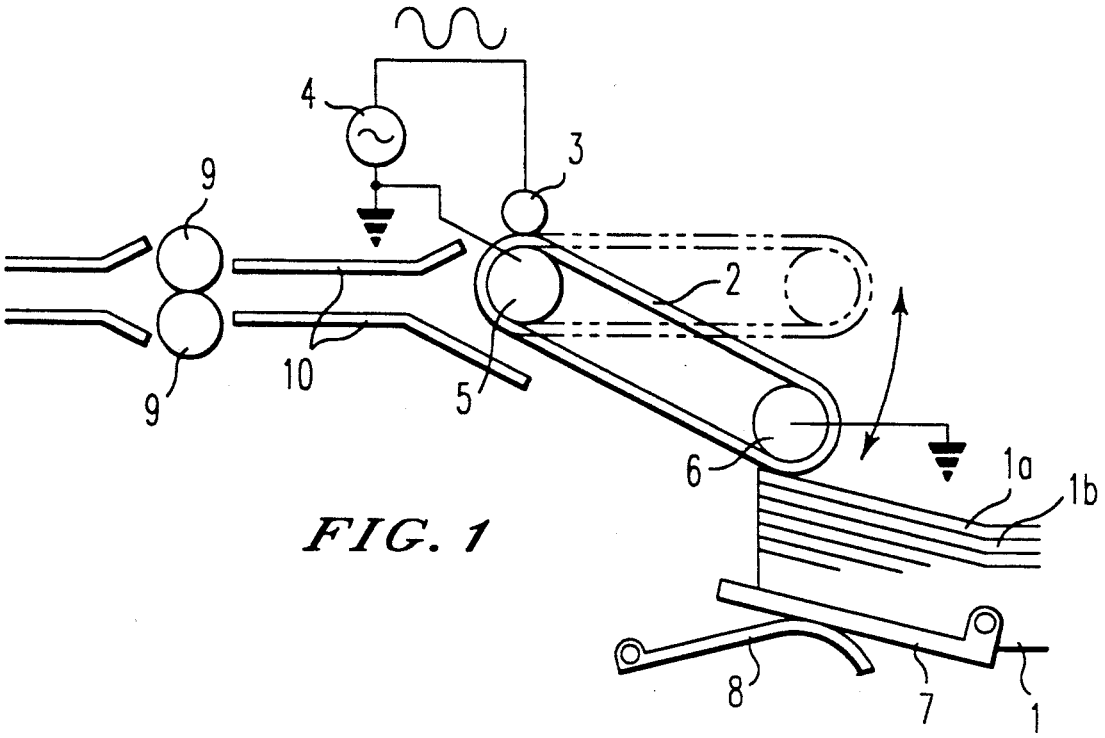
FIG. 1 is a section showing a first embodiment of the present invention.
Figure 2:
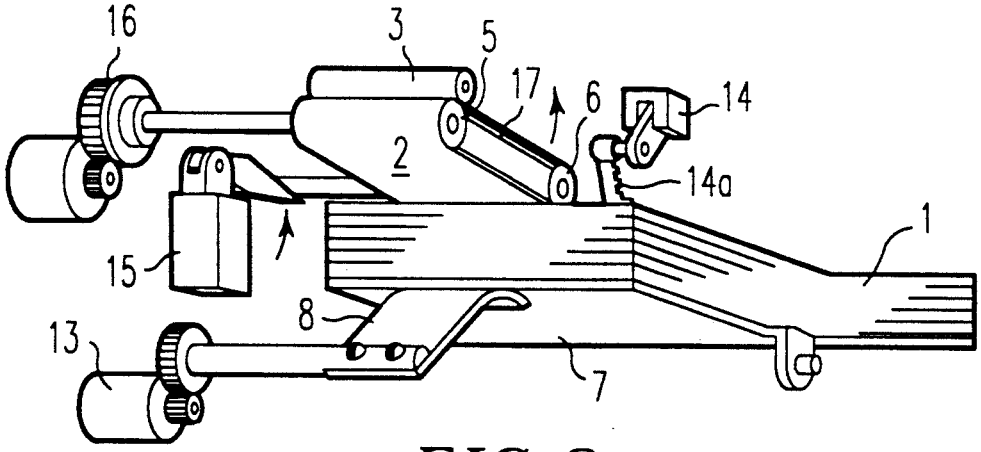
FIG. 2 is a perspective view associated with FIG. 1.

Referring to FIGS. 1 and 2 of the drawings, a first embodiment of the sheet feeding device in accordance with the present invention is shown. As shown, an endless belt 2 is passed over a drive shaft 5 and a driven shaft 6 to play the role of a pick-up member. The belt 2 is implemented as a film of dielectric substance whose resistance is higher than $10^8$ Ω·cm, e.g., an about 100 μm thick film of polyethylene terephthalate. The drive shaft or roller 5 is covered with a layer of conductive rubber having a resistance of $10^6$ Ω·cm while the driven shaft or roller 6 is made of metal. Both the drive roller 5 and the driven roller 6 are connected to ground. The drive roller 5 has a relatively small diameter for adequately separating a sheet from the belt 2 due to the curvature thereof. Actuated by a solenoid 15, FIG. 2, the belt 2 is movable about the drive roller 5 between an operative position and a inoperative position which are indicated by a solid line and a phantom line, respectively. In the operative position, the belt 2 contacts the uppermost one 1*a* of sheets 1 stacked on a bottom plate 7 which is raised by a pushing member 8. In the inoperative position, the belt 2 is spaced apart from the sheet stack 1. A roller electrode 3 is connected to an AC power source 4 and so positioned as to contact the portion of the belt 2 which wraps around the drive roller 5. A guide 10 for guiding a sheet and a transport roller pair 9 are located downstream of the belt 2 with respect to the intended direction of sheet feed. Ribs 17 are provided on opposite side edges of the inner periphery of the belt 2 and engaged with opposite ends of the rollers 5 and 6, preventing the belt 2 from being dislocated. The drive roller 5 is driven intermittently by a motor via an electromagnetic clutch 16 in response to a sheet feed signal. Elevation sensing means 14 is implemented as a photosensor and disposed above the sheet stack 1 loaded on the bottom plate 7. The photosensor 14 has a feeler 14*a* resting on the top of the sheet stack. An elevation motor 13 is turned on and off in response to the output of the photosensor 14 such that the top of the stack 1 is located at a predetermined feed position at all times.

Figure 3:
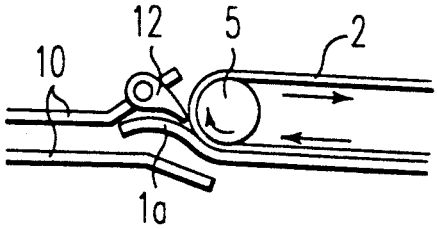
FIG. 3 is a section showing means included in the embodiment for separating a sheet from a belt.

In operation, as the electromagnetic clutch 16 is coupled by a sheet feed signal, the drive roller 5 is rotated to in turn rotate the belt 2. An alternating voltage is applied from the AC power source 4 to the belt 2 via the roller electrode 3 with the result that a charge pattern is formed on the surface of the belt 2. The charge pattern alternates at a pitch (preferably 5 mm to 15 mm) determined by the frequency of the power source 4 and the peripheral speed of the belt 2. The belt 2 with such a charge pattern contacts the front end of the top of the uppermost sheet 1*a* at the position where it wraps around the driven roller 6. Hence, the Maxwell stress acts on the sheet 1*a*, which is dielectric, due to a nonuniform electric field ascribable to the charge pattern of the belt 2, causing only the sheet 1*a* to adhere to the belt 2. As the belt 2 rotates, the sheet 1*a* is separated from the belt 2 due to the curvature of the latter and sequentially paid out in the direction of sheet feed. The guide 10 and roller pair 9 guide the sheet 1*a* toward an image forming station. The adhesion derived from the charge pattern acts only on the uppermost sheet 1*a* and does not act on any of the second sheet 1*b* and successive sheets. Since the illustrative embodiment does not rely on the friction between pick-up means and a sheet, the contact pressure acting between the belt 2 and the sheet stack 1 can be sufficiently reduced. This successfully prevents two or more sheets from being fed together. The roller pair 9 and the belt 2 are driven at the same linear velocity as each other. When the roller pair 9 is driven intermittently at predetermined timings, the belt 2 will also be controlled to rotate intermittently. Before the trailing edge of the sheet 1*a* being paid out reaches the position where the driven roller 6 is located, the belt 2 is moved away from the sheet stack 1 so as not to attract the second sheet 1*b*. A sheet is separated from the belt 1 at the position where the drive roller 5 is located due to the curvature of the roller 5, as stated earlier. To promote more positive separation, as shown in FIG. 3, a separator in the form of a pawl 12 may be used. In this embodiment, the power source 4 applies AC having an amplitude of 4 kV to the surface of the belt 2. Of course, such AC may be replaced with DC which is alternately switched over to a high potential and a low potential, if desired.

Figure 4:
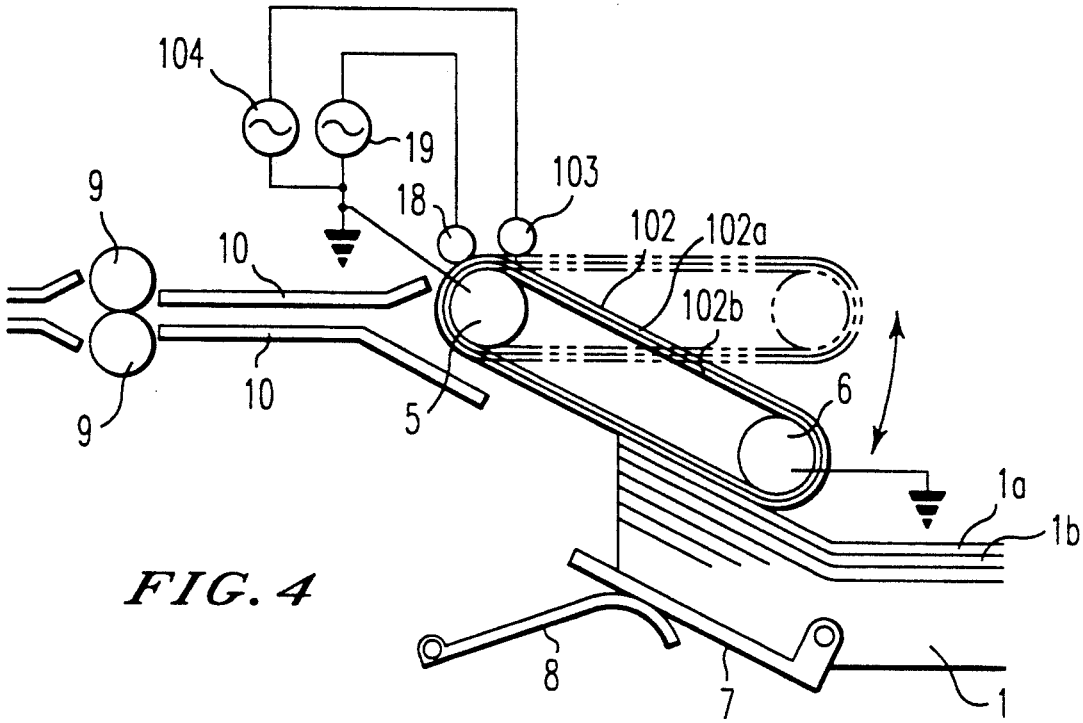
FIG. 4 is a section showing a second embodiment of the present invention.

FIG. 4 shows a second embodiment of the present invention having a laminate pick-up belt 102. Specifically, the pick-up belt 102 has an outer layer 102*a* constituted by a dielectric substance having a resistance higher than $10^8$ Ω·cm, and an inner layer 102*b* constituted by a conductive substance whose resistance is lower than $10^6$ ·cm. A charging electrode 103 is held in contact with the surface of the belt 102. Since the inner layer 102*b* of the belt 102 serves as a counter electrode connected to ground, the charging electrode 103 may be located at any desired position so long as it contacts the belt surface. The sheet stack 1 is positioned such that the uppermost sheet 1*a* adheres to the belt 102 over a substantial area. A discharging electrode 18 is located downstream of the separating position of the belt 102 and connected to an AC power source or discharge power source 19. The discharge electrode 18 is held in contact with or located in close proximity to the belt 102. The rest of the construction is the same as the first embodiment. In this embodiment, a charge power source 104 and the discharge power source 19 are so controlled as to cancel the attraction, which is exerted by the belt 102, at the instant when the leading edge of the sheet contacts the roller pair 9. Once the sheet is nipped by the roller pair 9, it is driven only by the force of the roller pair 9 without being effected by the belt 102.

Why the charge deposited on a dielectric belt being rotated is removed if an alternating voltage is applied to the belt will be described. Assume that a conductive roller or similar charging electrode is held in contact with the outer periphery of a dielectric belt being rotated, and that a DC voltage is applied to the belt from a DC power source. Then, the belt is not charged if the DC voltage applied thereto is lower than a particular voltage which will be referred to as a charge start voltage $V_o$. The charge start voltage $V_o$ changes with the thickness, volume resistivity and other factors of the belt. It was found by experiments that when an alternating voltage whose peak is the charge start voltage $V_o$ is applied to a discharging roller, the surface potential of a transfer belt is reduced substantially to zero. This suggests that when a voltage applied to a dielectric object to be charged has a peak which is the charge start voltage $V_o$, it exerts a moving force on the spatial charge deposited on the object although failing to charge the object, thereby removing the charge. When such an alternating voltage is used, the dielectric object can be discharged with no regard to the polarity of the charge. It was also found by experiments that voltages lower than the charge start voltage result in short discharging while voltages higher than the same result in charging at the applied frequency (120 Hz, v/f=1 mm period) and cannot reduce to the charge to 0 V. It, therefore, suffices to control the alternating voltage of the discharge power source 19 such that the peak thereof coincides with the charge start voltage for a dielectric belt.

Figure 5:
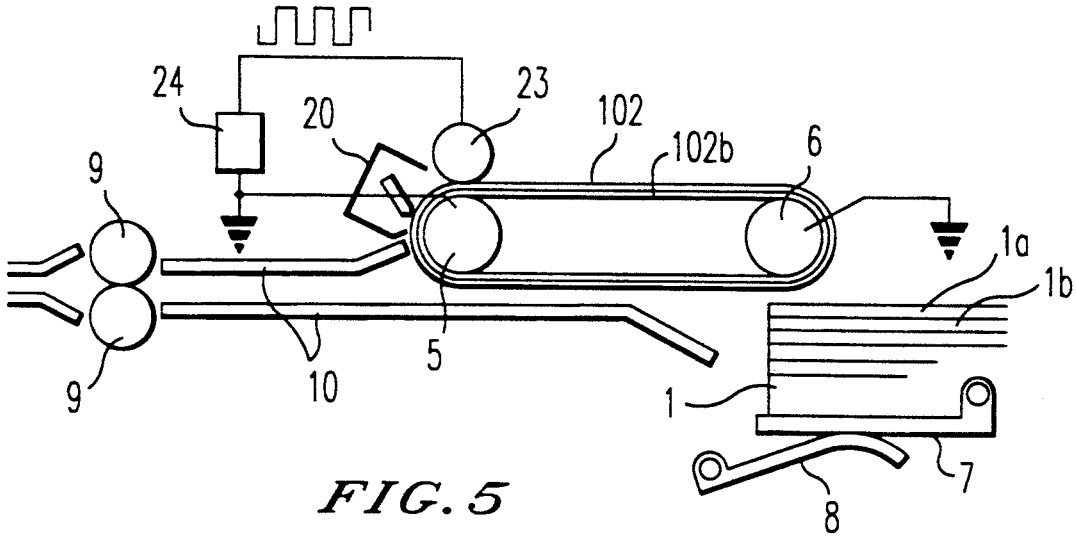
FIG. 5 is a section showing a third embodiment of the present invention.
Figure 6A:
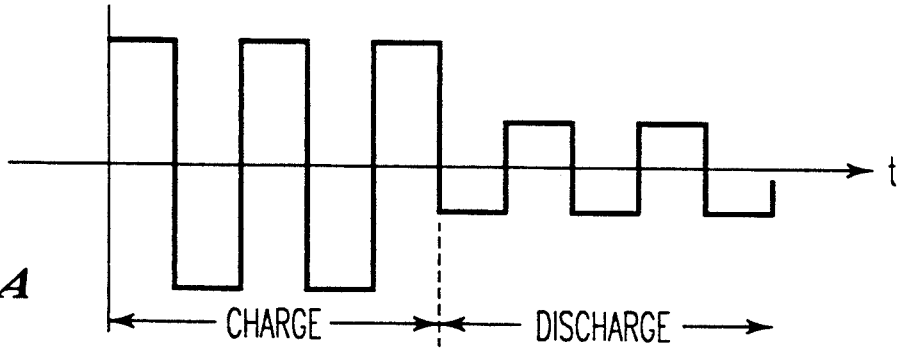
FIGS. 6A–6D each shows a particular waveform of a voltage which is applied to charging and discharging means included in the third embodiment.
Figure 6B:
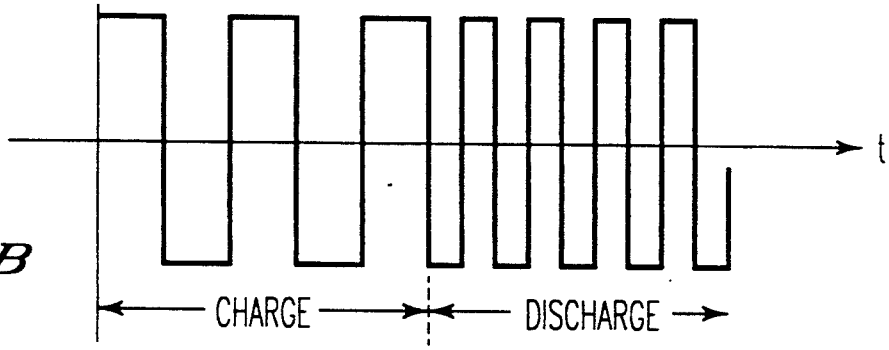
Figure 6C:
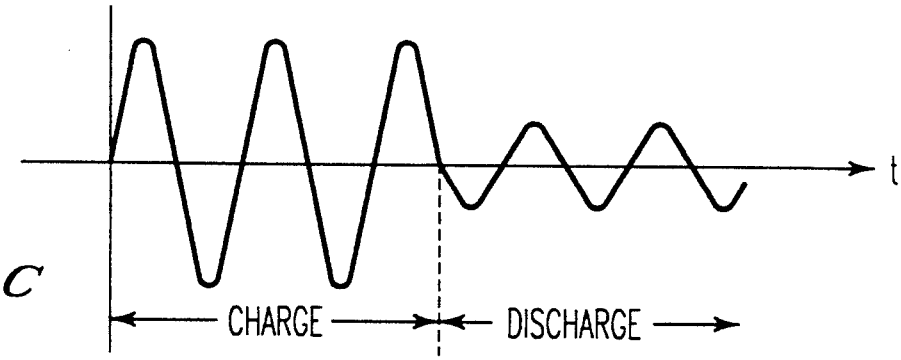
Figure 6D:
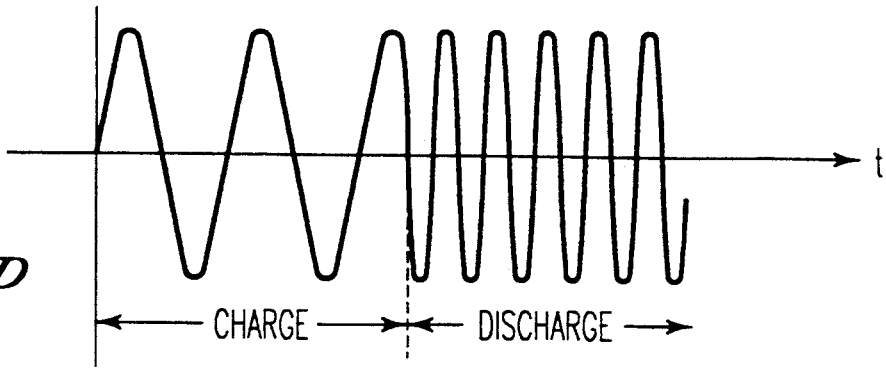

Referring to FIG. 5, a third embodiment of the present invention will be described. The same parts and elements of this embodiment as those of the first and second embodiments are designated by the same reference numerals. As shown, the belt 102 is fixed in place and lacks the mechanism for moving it toward and away from the sheet stack 1. An electrode 23 selectively serves as a charger or a discharger under the control of a power source controller 24. FIGS. 6A–6D show specific systems available for controlling the voltage applied to the electrode 23 and the frequency. The system shown in FIG. 6A removes the charge pattern from the belt 102 by lowering the voltage applied to the electrode 23. In FIG. 6A, the system increases the frequency of the power source to reduce the pitch of the charge pattern to be formed on the belt 102, thereby reducing the attraction due to the Maxwell stress. While the systems shown in FIGS. 6A and 6B each uses a rectangular wave produced by causing a DC power source to alternate, the same holds true when it is replaced with AC (FIGS. 6C and 6D). The sheet stack 1 is so positioned as to face the driven roller 6 at the front end thereof, as in the first embodiment. A cleaning member 20 is disposed downstream of the separating position of the belt 102 and upstream of the electrode 23. The sheet stack 1 is raised to a position where the top thereof is spaced apart from the surface of the belt 102 by a small gap. At a sheet feed timing, the electrode 23 forms a charge pattern on the surface of the belt 102. As the charged portion of the belt 102 approaches the front end of the sheet stack 1, the uppermost sheet 1*a* adheres to the surface to the belt 102 and is entrained thereby. The belt 102 is charged over a length equal to the length of the transport path extending from the separating position of the belt 102 to the roller pair 9. Thereafter, the electrode 23 performs a discharging operation under the control of the electrode controller 24. As a result, after the sheet 1*a* has been nipped by the roller pair 9, it is transported only by the driving force of the roller pair 9 without being effected by the belt 102. Since the belt 102 is discharged and a small gap exists between the belt 102 and the sheet stack, the sheet 1*b* underlying the sheet 1*a* is prevented from being paid out just after the sheet 1*b*. This embodiment does not use friction in separating a sheet from the sheet stack 1 and, therefore, produces a minimum of paper dust during sheet feeding operations. Although paper dust may have been deposited on the sheet stack and may stick to the surface of the belt 102, the cleaning member 20 removes such paper dust. This is successful in preventing paper dust from disturbing the sequence of sheet feeding steps and in eliminating the simultaneous feed of two or more sheets.

Other embodiments of the present invention will be described hereinafter. The following embodiments differ from the previous ones in that an arresting member faces the pick-up member with the intermediary of the transport path in order to separate sheets which may be paid out together by the pick-up member, and in that an alternating charge pattern is formed on either one of the pick-up member and the arresting member to insure the separation. Specifically, fourth to seventh embodiments which will be described form a charge pattern on the pick-up member and use a friction member or similar mechanical means as the arresting member, while eighth and ninth embodiments use the pick-up member as a friction member and form a charge pattern on the arresting member.

The fourth to seventh embodiments are essentially similar to the first to third embodiments except that a friction member or similar conventional arresting member is associated with the pick-up member, i.e., dielectric belt.

Figure 7:
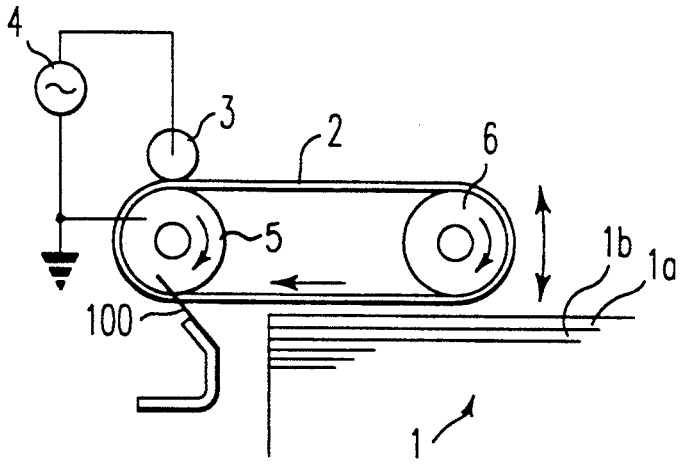
FIG. 7 is a section showing a fourth embodiment of the present invention.
Figure 8:
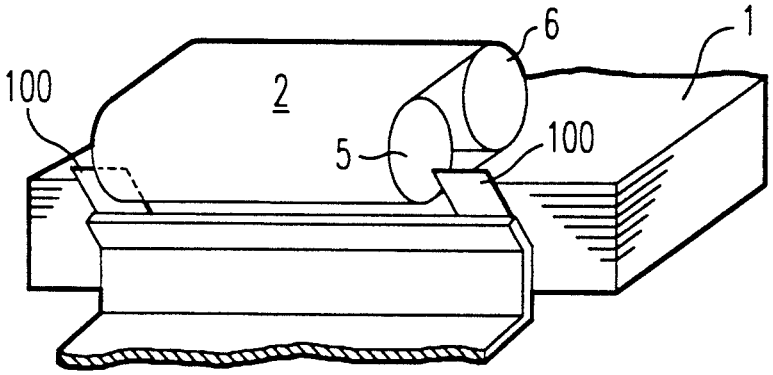
FIG. 8 is a perspective view of the fourth embodiment.

Referring to FIGS. 7 and 8, the fourth embodiment has the belt or pick-up member 2 passed over the drive roller 5 and driven roller 6. An AC voltage is applied from the AC power source 4 to the roller electrode 3 which is held in contact with the surface of the belt 2. The belt 2 has an about 50 μm thick outer layer having a resistance higher than $10^8$ and made of polyethylene terephthalate, and a conductive inner layer deposited on the back of the outer layer by the evaporation of aluminum and having a resistance lower than $10^6$ Ω·cm. The drive roller 5 is covered with a layer of conductive rubber whose resistance is lower than $10^6$ Ω·cm and is connected to ground. The belt 2 is movable about the drive roller 5 into and out of contact with the top of the sheet stack 1 which is held at a predetermined height at all times. The roller electrode 3 is located to face the portion of the drive roller 5 with which the belt 2 constantly contacts, so that the contact of the belt 2 with the sheet stack 1 may not effect the sheet feed operation. In the illustrative embodiment, an elastic thin member 100 made of polyethylene terephthalate or similar substance is located such that it faces the belt 2 crosswise in the axial direction of the drive roller 5 and protrudes above a plane containing the feed surface of the belt 2. This member 100 is fixed in place at the base portion thereof. Since the contact pressure between the belt 2 and the sheet stack is low enough (zero to several ten gf) to eliminate a force ascribable to the friction of the uppermost sheet 1*a* and underlying sheet 1*b*, the probability that two or more sheets are fed together is scarce. It is likely, however, that the uppermost sheet 1*a* entrains the underlying sheet 1*b* due to adhesion ascribable to static electricity between sheets or due to the irregular edges of sheets. In such a condition, the first sheet 1*a* strongly adheres to the belt 2 due to the Maxwell stress generated by the charge pattern and is, therefore, transported by the belt 2 while deforming the member 100. However, when the second sheet 1*b* being entrained by the first sheet 1*a* is brought into contact with the member 100, the member 100 elastically presses it against the leading edge or the back of the sheet 1*b*. As a result, the sheet 1*b* slips on the sheet 1*a* and cannot advance any further due to the friction between it and the member 100.

The rest of the operation is essentially the same as the operation of the first to third embodiments and will not be described to avoid redundancy.

Figure 9:
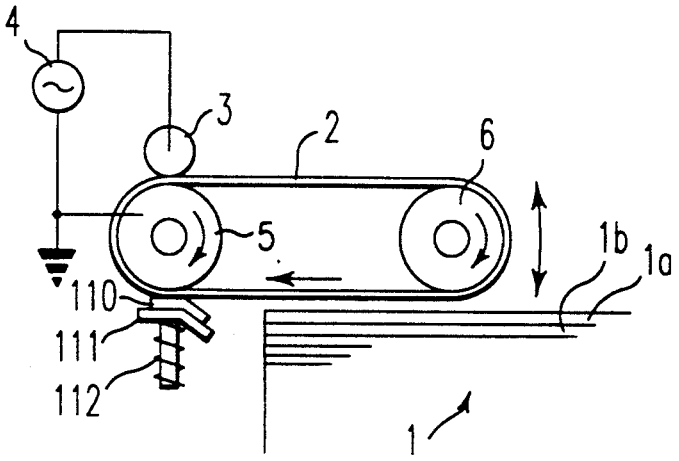
FIG. 9 is a section showing a fifth embodiment of the present invention.
Figure 10:
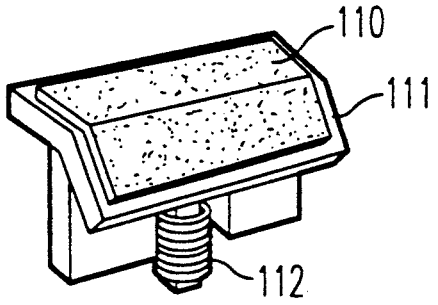
FIG. 10 is a perspective view associated with FIG. 9.

A reference will be made to FIGS. 9 and 10 for describing the fifth embodiment of the present invention. The same parts and elements of this embodiment as those of the fourth embodiment are designated by the same reference numerals. As shown, a friction member 110 is located to face the drive roller 5 with the intermediary of the belt 2. The friction member 110 is bonded to a bracket 111 and pressed against the belt 2 by a pressure less than 500 gf. When two or more sheets are paid out together by the belt 2, the second sheet 1*b* is separated from the first sheet 1*a* due to the friction thereof with the friction member 110 and is stopped there. The friction member 110 does not obstruct the transport of the sheet 1*a* retained by the belt 2 since the contact pressure thereof is as low or less than 500 gf, as stated above. In addition, the coefficient of friction between the friction member 110 and the sheet 1*a* is greater than the coefficient of friction between the sheets 1*a* and 1*b*. As a result, only the sheet 1*a* is retained and transported by the belt 2, as in the fourth embodiment.

Figure 11:
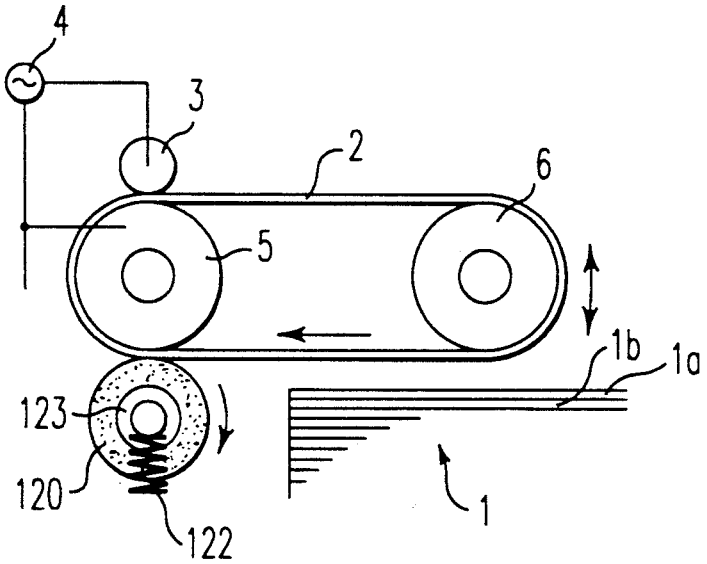
FIG. 11 is a section showing a sixth embodiment of the present invention.
Figure 12:
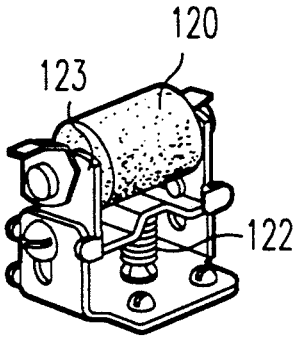
FIG. 12 is a perspective view of an arresting member included in the sixth embodiment.

FIGS. 11 and 12 show the sixth embodiment of the present invention. The same parts and elements of this embodiment as those of the fourth embodiment are designated by the same reference numerals. As shown, a friction member 120 faces the drive roller 5 with the intermediary of the belt 2 and is implemented as a roller. A one-way clutch 123 intervenes between the friction member 120 and a shaft on which the friction member 120 is mounted, allowing the member 120 to rotate only in a direction indicated by an arrow in FIG. 11. A compression spring or similar biasing means 122 constantly biases the friction member 120 against the belt 2 by a pressure less than 500 gf. When two or more sheets are paid out together by the belt 2, the second sheet 1*b* is separated from the first sheet 1*a* due to the friction thereof with the friction member 120 and is stopped there. The friction member 120 does not obstruct the transport of the sheet 1*a* retained by the belt 2 since the contact pressure thereof is as low as less than 500 gf, as stated above. In addition, the coefficient of friction between the friction member 120 and the sheet 1*a* is greater than the coefficient of friction between the sheets 1*a* and 1*b*. As a result, only the sheet 1*a* is retained and transported by the belt 2, as in the fourth embodiment.

Figure 13:
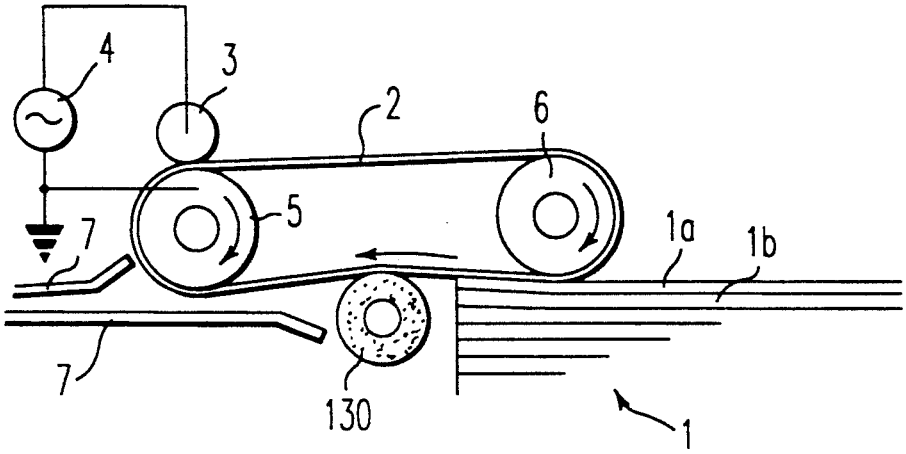
FIG. 13 is a section showing a seventh embodiment of the present invention.
Figure 14:
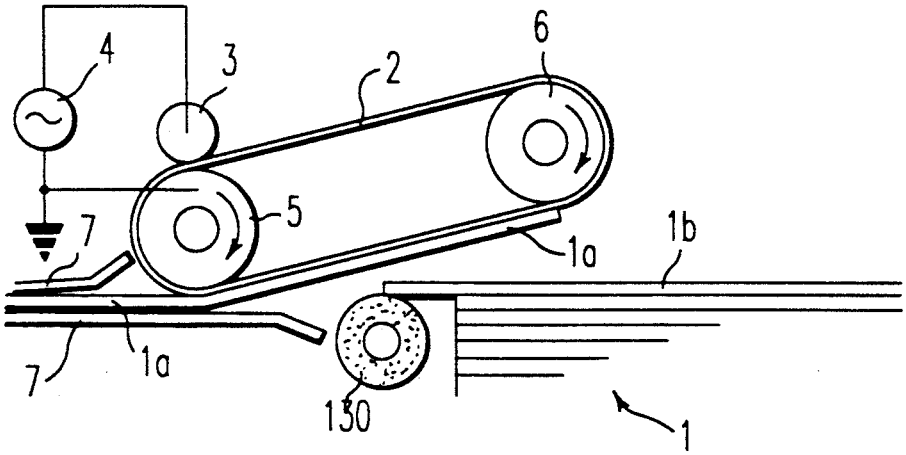
FIG. 14 is a section similar to FIG. 13, demonstrating the operation of the embodiment.

FIGS. 13 and 14 show the seventh embodiment of the present invention. The same parts and elements as those of the fourth embodiment are designated by the same reference numerals. As shown, a friction member 130 abuts against the feed surface of the belt 2 in a position where the belt 2 contacts the sheet stack 1. When the belt 2 contacts the top of the sheet stack 1, the friction member 130 exerts a contact pressure due to the resulting stretch of the belt 2. The contact pressure is selected to be less than 500 gf. When two or more sheets are paid out together by the belt 2, the second sheet 1*b* is separated from the first sheet 1*a* due to the friction thereof with the friction member 130 and is stopped there. The friction member 130 does not obstruct the transport of the sheet 1*a* retained by the belt 2 since the contact pressure thereof is as low as less than 500 gf, as stated above. In addition, the coefficient of friction between the friction member 130 and the sheet 1*a* is greater than the coefficient of friction between the sheets 1*a* and 1*b*. Moreover, as soon as the belt 2 is moved away from the sheet stack 1, it is also moved away from the friction member 130 while retaining the uppermost sheet 1*a*. As a result, only the uppermost sheet 1 is retained by and transported by the belt 2.

Figure 15:
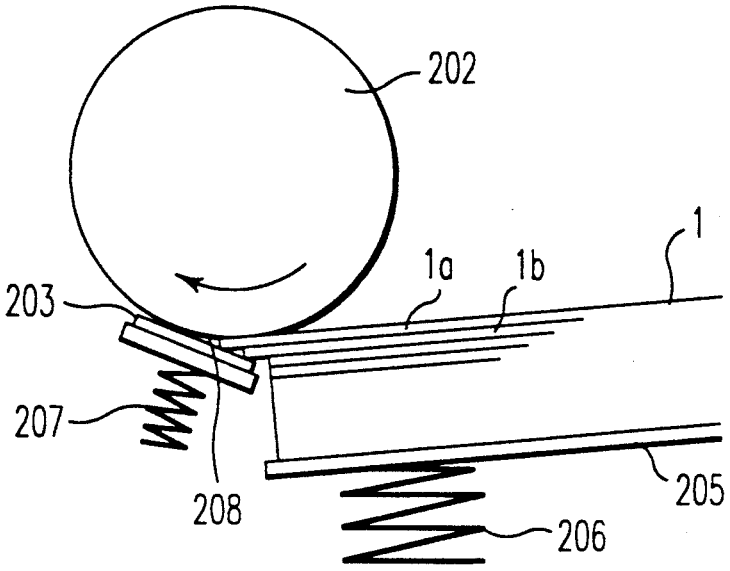
FIG. 15 is a section showing an eighth embodiment of the present invention.
Figure 16:
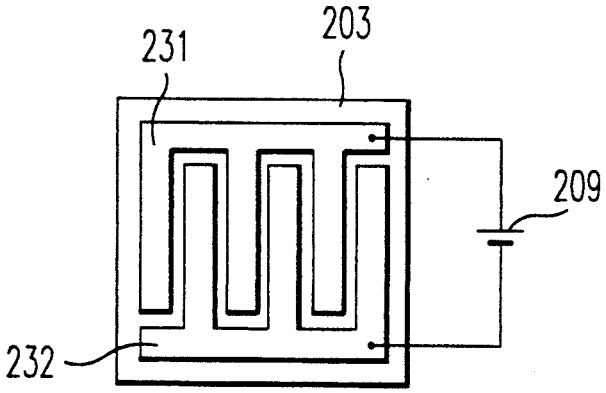
FIG. 16 is a plan view of a pad included in the embodiment of FIG. 15.
Figure 17:
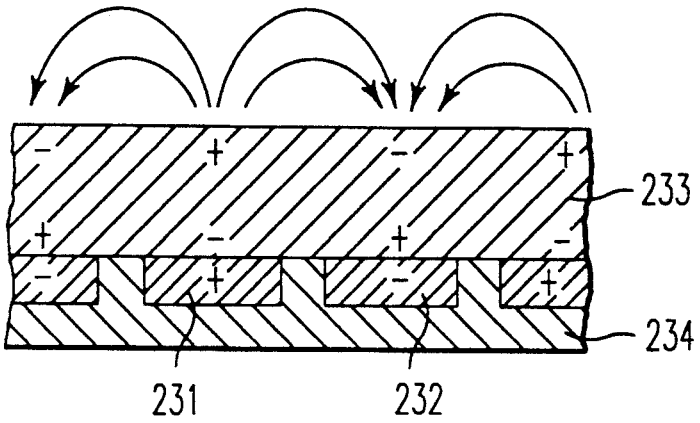
FIG. 17 is a vertical section of the pad.

Referring to FIGS. 15–17, the eighth embodiment of the present invention will be described. As shown in FIG. 15, a bottom plate 205 is loaded with a stack of sheets 1 and constantly biased upward by a spring 206, so that the top of the sheet stack 1 is pressed against a pick-up roller 202. A pad 203 is constantly biased by a spring 207 to abut against the pick-up roller 202 by a predetermined pressure. A charge pattern is formed on the pad 203 by an arrangement which will be described, causing the pad 203 to exert an attracting force. As shown in FIG. 16, two potential pattern forming electrodes 231 and 232 each having a comb-like configuration are embedded in the pad 203 such that the teeth thereof alternate with each other. A DC power source 209 is connected to the electrodes 231 and 232 to set up a potential difference therebetween. As shown in FIG. 17, the surface of the pad 203 that contacts the sheet is implemented by a dielectric layer 233. The pattern forming electrodes 231 and 232 are buried in an insulating layer 234 underlying the dielectric layer 233. In this configuration, the electrodes 231 and 232 produce an alternating charge density pattern on the surface of the dielectric layer 233, thereby generating electrostatic fields. As a result, the Maxwell stress acts on the sheets 1 adjoining the surface of the dielectric layer 233 and thereby causes the sheets 1 to adhere to the pad 203. In operation, as the pick-up roller 202 is rotated, it pays out the uppermost sheet 1*a* to a nipping position 208 between the roller 202 and the pad 203. Then, the pad 203 tends to arrest the sheet 1*a* due to the above-mentioned attraction. If it is only the uppermost sheet 1*a* that has reached the nipping position 208, the sheet 1*a* is allowed to advance since the transporting force ascribable to the friction between the pick-up roller 202 and the sheet 1*a* is greater than the counter force being exerted by the pad 203. On the other hand, when the sheet 1*a* entered the nipping position 208 is entraining the underlying sheet 1*b*, only the sheet 1*a* is transported while the sheet 1*a* is stopped at the position 208. This is because the force of the pad 203 tending to arrest the sheet 1*b* is greater than the friction between the sheets 1*a* and 1*b*.

Figure 18:
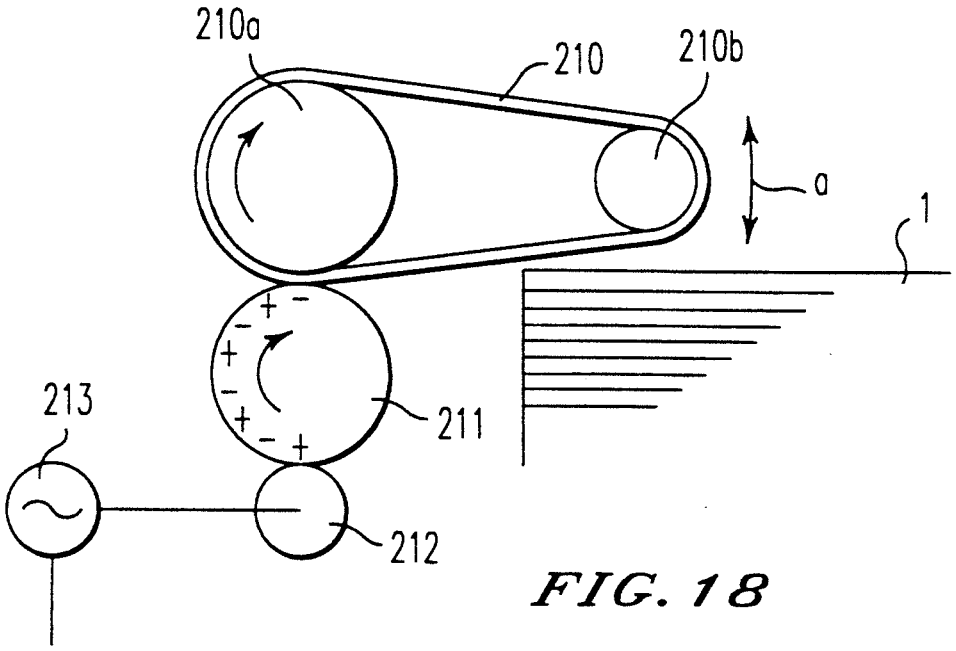
FIG. 18 is a section showing a ninth embodiment of the present invention.

FIG. 18 shows the ninth embodiment of the present invention. As shown, a belt 210 is passed over a drive roller 210*a* and a driven roller 210*b*. A separation roller 211 is held in contact with the belt 210 at a position where the drive roller 210*a* is located. The separation roller 211 is driven in a direction for returning a sheet which may be entrained by an overlying sheet. A pattern forming electrode 212 is held in contact with the separation roller 211 for applying a charge density pattern to the surface of the roller 211. An AC power source is connected to the electrode 212 for applying an AC voltage to the latter. To feed a sheet, the driven roller 210*b* is moved up and down, as indicated by an arrow a, by rotating means, not shown. As a result, the belt 210 sequentially picks up and feeds the sheets 1 on the basis of the coefficient of friction of the belt 210. When a plurality of sheets 1 are paid out together, the underlying sheet adheres to the separation roller 211 due to the attraction derived from the charge density pattern of the roller 211. Consequently, the underlying sheet is separated from the overlying sheet and returned to the sheet stack 1.

In summary, it will be seen that the present invention achieves various unprecedented advantages, as enumerated below.

(1) A dielectric belt carrying an alternating charge pattern thereon picks up a sheet from a sheet stack by adhesion. Hence, the adhesion remains stable against aging and against changes in environmental conditions, preventing two or more sheets from being paid out together.

(2) The intensity of adhesion is variable by a frequency control section, as desired.

(3) The peripheral speed of the belt is adjustable to change the pitch of the charge pattern and, therefore, the intensity of adhesion, as needed.

(4) The belt is movable into and out of contact with the top of the sheet stack. Hence, sheets can be sequentialy fed at predetermined intervals without resorting to the control over the charge.

(5) An inner or back layer provided on the belt plays the role of a counter electrode, allowing any desired positional relation to be set up between the belt and the sheets.

(6) Charges deposited on the area of the belt other than the sheet adhering area are removed, so that paper dust and other impurities are prevented from depositing on the belt. This makes it needless for the belt to be moved into and out of contact with the sheets.

(7) Since a discharging member limits the charging area of the belt, a charging member is allowed to operate continuously, eliminating the need for control. The discharging member and the charging member can be implemented as a single member to save space and cost.

(8) The charging and discharging functions available with a single member can be switched over with ease.

(9) The belt eliminates the contact pressure between the uppermost sheet and the underlying sheet despite the weight thereof. This reduces not only the amount of paper dust during sheet feed operations but also the probability of the simultaneous feed of two or more sheets.

(10) Means for forming an alternating charge pattern is associated with either one of a pick-up member and an arresting member which face each other with the intermediary of a transport path, the arresting member being movable in the counter-feed direction or held stationary. Electrostatic attraction due to the charge pattern separates the uppermost sheet from the underlying sheet. This kind of sheet separation is more stable than the conventional friction type sheet separation.

(11) When the charge pattern is formed on the dielectric belt, the uppermost sheet can be stably separated from the underlying sheet which may be entrained by the former.

(12) The sheet entraining the underlying sheet is transported by the dielectric belt while being intensely attracted by the belt. An elastic thin member elastically hits against the underlying sheet to prevent it from advancing any further.

(13) Even when a friction member serving as the arresting member contacts the feed surface of an endless belt by a low pressure, the belt surely attracts and transports the overlying sheet. The underlying sheet is positively separated from the overlying sheet by the difference between the coefficient of friction between the sheets and the coefficient of fiction between the sheet and the friction member.

(14) The friction member is located to face a roller around which the endless belt wraps, the friction member presses itself against the belt by a constant pressure, enhancing the stable separation of sheets.

(15) As soon as the belt is released from the top of the sheet stack, the friction member is released from the belt, insuring the smooth transport of a sheet.

(16) Means for forming an alternating charge pattern on the surface of the arresting member is also capable of eliminating the simulaneous feed of multiple sheets despite that the contact pressure is low.

(17) Pattern forming means indepenent of the separating means applies an alternating voltage to the separating means.

(18) When two or more sheets are paid out together to between a pick-up and a pad, a charge density pattern formed on the pad separates the overlying sheet from the underlying sheet.

(19) A charge density pattern formed on the surface of a belt-like member separates overlapping sheets from each other.

(20) The separating means is rotated by drive means in a direction for separating overlapping sheets, preventing the simultaneous feed of sheets more positively.

Thus, the present invention implements a sheet feeding and separating device which is operable stably without the need for considering the decrease in the coefficient of friction and eliminates the need for the replacement of parts to thereby enhance the service and cut down the cost.

Various modifications will become possible for those skilled in the art after receiving the teachings of the present disclosure without departing from the scope thereof.

What is claimed is:

1. A sheet feeding device comprising:

sheet pick-up means facing and spaced from the top of a stack of sheets, said sheet pick-up means being movable in an intended direction of sheet feed for picking up an uppermost sheet from the stack of sheets, said sheet pick-up means comprising an endless dielectric belt;

means for rotating said dielectric belt in at least said intended direction of sheet feed; and charge pattern forming means for applying an alternating voltage to a surface of said belt to thereby form an alternating charge pattern on said surface of the belt, said charge pattern forming means comprising a charging and discharging member associated with said dielectric belt and having a charging function and a discharging function;

wherein:

said charging and discharging member forms a charge on a surface portion of said belt for picking up the uppermost sheet and causing the uppermost sheet to adhere to said charged surface portion of the belt, such that said rotating means rotates said belt to transport said picked-up uppermost sheet in said intended direction of sheet feed and to a position where the picked-up uppermost sheet is separated from the belt and guided by way of a guiding path to a transport roller pair;

said charged surface portion of said belt has a length which is substantially equal to a length of said guiding path from the position where the picked-up uppermost sheet is separated from the belt to the transport roller pair; and said charging and discharging member discharges said belt when the separated sheet is nipped by said transport roller pair.

2. A device as claimed in claim 1, wherein said charging and discharging functions of said charging and discharging member are switched over by changing a voltage to be applied thereto.

* * * * *